US011313085B2

(12) United States Patent
Oettinger

(10) Patent No.: US 11,313,085 B2
(45) Date of Patent: Apr. 26, 2022

(54) TRANSVERSE DISTRIBUTOR ARRANGEMENT FOR A ROAD FINISHER

(71) Applicant: JOSEPH VOEGELE AG, Ludwigshafen/Rhein (DE)

(72) Inventor: Klaus Oettinger, Altlussheim (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 154 days.

(21) Appl. No.: 16/911,532

(22) Filed: Jun. 25, 2020

(65) Prior Publication Data

US 2020/0407926 A1 Dec. 31, 2020

(30) Foreign Application Priority Data

Jun. 26, 2019 (EP) ..... 19182531

(51) Int. Cl.
*E01C 19/48* (2006.01)
*E01C 19/20* (2006.01)

(52) U.S. Cl.
CPC ..... *E01C 19/202* (2013.01); *E01C 19/48* (2013.01)

(58) Field of Classification Search
CPC ..... E01C 19/202; E01C 19/48
USPC ..... 404/118
See application file for complete search history.

(56) References Cited

U.S. PATENT DOCUMENTS 4,708,519 A * 11/1987 Davin ..... E01C 19/4873 404/101
4,749,304 A * 6/1988 Craig ..... E01C 19/42 404/101
5,354,189 A * 10/1994 McKinnon ..... E01C 19/4893 404/98
5,967,427 A * 10/1999 Seymour ..... B01F 7/081 239/676
7,381,131 B1 * 6/2008 Harpole ..... A01F 12/46 198/671

(Continued)

FOREIGN PATENT DOCUMENTS

CN 104480841 A 4/2015
CN 204401416 U 6/2015

(Continued)

OTHER PUBLICATIONS

Japanese Office Action (with English Machine Translation) dated Oct. 5, 2021, Application No. 2020-086459, 6 Pages.

(Continued)

*Primary Examiner* — Raymond W Addie
(74) *Attorney, Agent, or Firm* — Brooks Kushman P.C.

(57) ABSTRACT

A transverse distributor arrangement for a road finisher with a center console and counter-rotating augers, wherein the augers each extend from the center console to outer end regions with auger elements attached thereto and a base shaft. The base shaft is mounted in an outer bearing, the outer bearing being mountable at an attachment point via an outer bearing bracket. An extending shaft can be attached to the base shaft, or the base shaft can be replaced by a replacement base shaft of a different length than the base shaft. According to the disclosure, the base shaft and the outer bearing are detachably connected to each other, the same outer bearing in its state detached from the base shaft being detachably mountable on the extending shaft or on the replacement base shaft.

17 Claims, 5 Drawing Sheets

(56) References Cited

U.S. PATENT DOCUMENTS

| | | | | |
|---|---|---|---|---|
| 7,458,747 | B2 * | 12/2008 | Musil | E01C 19/185 404/101 |
| 8,322,947 | B2 * | 12/2012 | Neumann | E01C 19/2045 404/104 |
| 8,714,872 | B2 | 5/2014 | Schmidt et al. | |
| 2017/0314215 | A1 * | 11/2017 | Graham | E01C 19/48 |

FOREIGN PATENT DOCUMENTS

| | | | |
|---|---|---|---|
| CN | 207712836 | U | 8/2018 |
| EP | 1 120 495 | A1 | 8/2001 |
| EP | 2 650 442 | B1 | 6/2018 |
| JP | H0827722 | A | 1/1996 |
| JP | H 11-262323 | A | 9/1999 |
| JP | 2000-087308 | A | 3/2000 |
| JP | 2003-232008 | A | 8/2003 |

OTHER PUBLICATIONS

European Search Report dated Jan. 7, 2020, Application No. 19182531.
4-1002, Applicant Joseph Voegele AG, 7 Pages.

* cited by examiner

TRANSVERSE DISTRIBUTOR ARRANGEMENT FOR A ROAD FINISHER

CROSS-REFERENCE TO RELATED APPLICATIONS

This application claims foreign priority benefits under 35 U.S.C. § 119(a)-(d) to European patent application number EP 19 182 531.4, filed Jun. 26, 2019, which is incorporated by reference in its entirety.

TECHNICAL FIELD

The present disclosure refers to a transverse distributor arrangement for a road finisher.

BACKGROUND

Transverse distributor arrangements are known from EP 1 120 495 A1 and EP 2 650 442 B1, for example. They are attached to the rear end of the chassis of the road finisher, namely between the chassis and a paving screed towed by the towing vehicle. Paving material, for example bituminous paving mix, is conveyed to the transverse distributor by means of a longitudinal conveyor, also known as a scraper belt. This transverse distributor arrangement has the task of spreading the paving mix in transverse direction of the road finisher so that the paving material is available across the full width of the following paving screed. For this purpose, the transverse distributor arrangement typically has two augers, namely a left and a right auger. Each auger has one base shall. Due to the considerable forces involved, the outer ends of the base shafts are not usually freely supported, but are each supported in an outer bearing, which is attached to the chassis of the road finisher by means of an outer bearing bracket.

If a large working width of the screed is required today, the auger must also be extended to ensure that the mix is spread across the full width. For large working areas this is solved either by means of extending shafts with outer bearings which are mounted on the base shaft of the auger. Or the base shaft is dismantled and replaced by a replacement shaft with a different length than the base shaft and with its own outer bearing. In the first case, there are a plurality of bearings in the mix after the extending shaft installation, which makes it difficult to circulate the paving material. In addition, the conversion work and bearing support are considerable, since each shaft has "its" outer bearing already mounted, which is usually inseparably mounted on the shaft by means of a press fit.

SUMMARY

Consequently, an object of the present disclosure is to provide an improved design for transverse distributor arrangements for road finishers and a method of assembling such transverse distributor arrangements in order to eliminate the disadvantages listed above.

This Object is accomplished by a modular transverse distributor arrangement for a road finisher according to the disclosure, or by a method of assembling transverse distributor arrangements for a road finisher according to the disclosure.

The transverse distributor arrangement for a road finisher provides a center console and counter-rotating augers, the augers each having auger elements attached thereto and a base shaft extending from the center console to outer end regions. The base shaft is supported in an outer bearing, whereby the outer bearing can be mounted on an attachment point via an outer bearing bracket. An extending shaft can be attached to the base shaft or the base shaft can be replaced by a replacement base shaft with a different length than the base shaft. According to the disclosure, the base shaft and the outer bearing are detachably connected to each other, whereby the same outer bearing in its detached state from the base shaft can be detachably mounted on the extending shaft or on the replacement base shaft.

An advantage of this modular concept for the design of the transverse distributor arrangement for a road finisher is the reduction of the number of different components in the support. The components are also easier to handle. This simplifies the conversion for the auger extending. In addition, the design according to the disclosure of the transverse distributor arrangement reduces the number of outer bearings in the mix, thus improving the material flow.

The respective first or second attachment point can be located on a structural element of the road finisher that is stationary relative to the center console or on a limiting plate that is attached to the structural element.

The first/second attachment points of the outer bearing bracket differ from one another, but, are each stationary relative to the towing vehicle of the road finisher, especially relative to the center console.

In particular, the outer bearing may comprise one or more transition wings. A transition wing enables the outer bearing to be connected to the shafts. Two transition wings on one side of the outer bearing allow the outer bearing to be connected to the shafts, and on the other side of the outer bearing further components, such as worm elements, can be attached.

Expediently, a transition wing of the outer bearing can be mounted with the base shaft or the extending shaft or the replacement base shaft via one or more connecting elements.

It is particularly advantageous if the outer bearing can be mounted with the base shaft or with the extending shaft or with the replacement base shaft in a connection that can be detached without tools. This makes it possible to reduce the amount of work required to reconfigure the auger extendings and the amount of attachment material, e.g., screws, required during conversion, thus saving time.

The connection between the outer bearing and the shaft, which can be detached without tools, can be achieved in particular with a gear coupling, the outer bearing having a splined profile, while the base shaft, the extending shaft and the replacement base shaft have another splined profile complementary to the splined profile of the outer bearing.

It is particularly reliable to secure the connection between the outer bearing and the base shaft or the extending shaft or the replacement base shaft, which can be detached without tools, by axially securing the base shaft or the extending shaft or the replacement base shaft with the outer bearing.

The disclosure further provides a method of assembling a transverse distributor arrangement for a road finisher, in which first the outer bearing bracket is detached from a first attachment point and the outer bearing is detached from the base shaft. In addition, an extending shaft is attached to the base shaft, whereby the outer bearing bracket is attached at a second attachment point and the outer bearing is detachably fixed to the extending shaft.

The outer bearing bracket is preferably detached from a first attachment point which can be placed on a structural element of the road finisher that is stationary relative to the center console or on a limiting plate attached to the structural element.

The outer bearing bracket is preferably attached to a second attachment point, which can be located on a structural element of the road finisher that is stationary relative to the center console or on a limiting plate that is attached to the structural element.

Expediently, an axial locking between the base shaft and the outer bracket is released and the extending shaft base shaft is axially secured to the outer bearing.

In another alternative method according to the disclosure, for the assembly of a transverse distributor arrangement for a road finisher, the outer bearing bracket is detached from a first attachment point of the structural element and the outer bearing is detached from a base shaft. Furthermore, the base shaft is replaced by a replacement base shaft, which has a different length than the base shaft. Finally, the outer bearing bracket is attached to a second attachment point and the outer bearing is detachably attached to the replacement base shaft.

Expediently, an axial locking between the base shaft and the outer bracket is released and the replacement base shaft is axially secured to the outer bearing.

The outer bearing bracket is preferably released from a first attachment point which can be placed on a structural element of the road finisher that is stationary relative to the center console or on a limiting plate attached to the structural element.

The outer bearing bracket is preferably mounted at a second attachment point, which can be located on a structural element of the road finisher that is stationary relative to the center bracket or on a limiting plate that is attached to the structural element.

Alternatively, the second attachment point can be arranged on a limiting plate, in which case the limiting plate is attached to the structural element, for example.

BRIEF DESCRIPTION OF THE DRAWINGS

In the following, exemplary embodiments are explained in more detail using the Figures.

DETAILED DESCRIPTION

Figure 1:
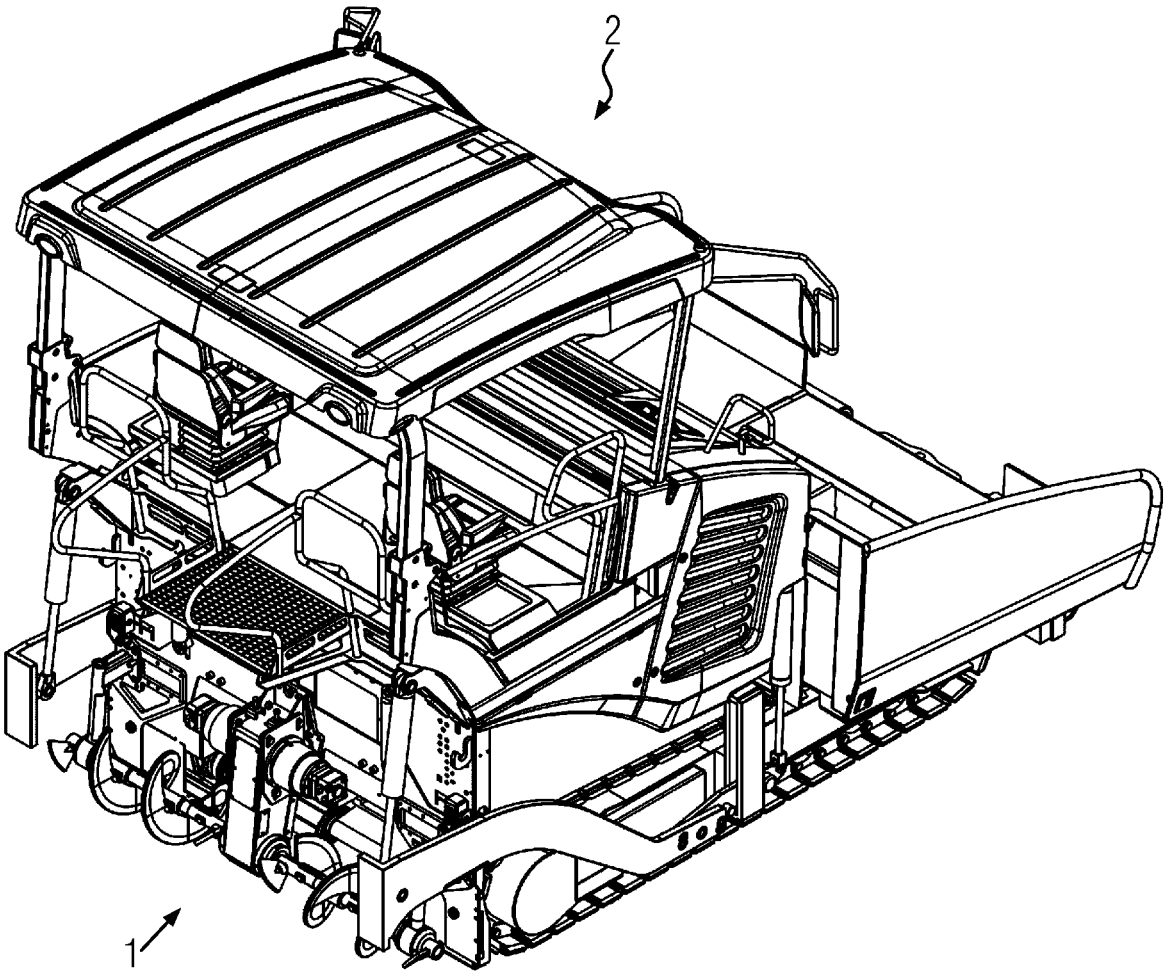
FIG. 1 shows a schematic perspective view of a road finisher.
Figure 2:
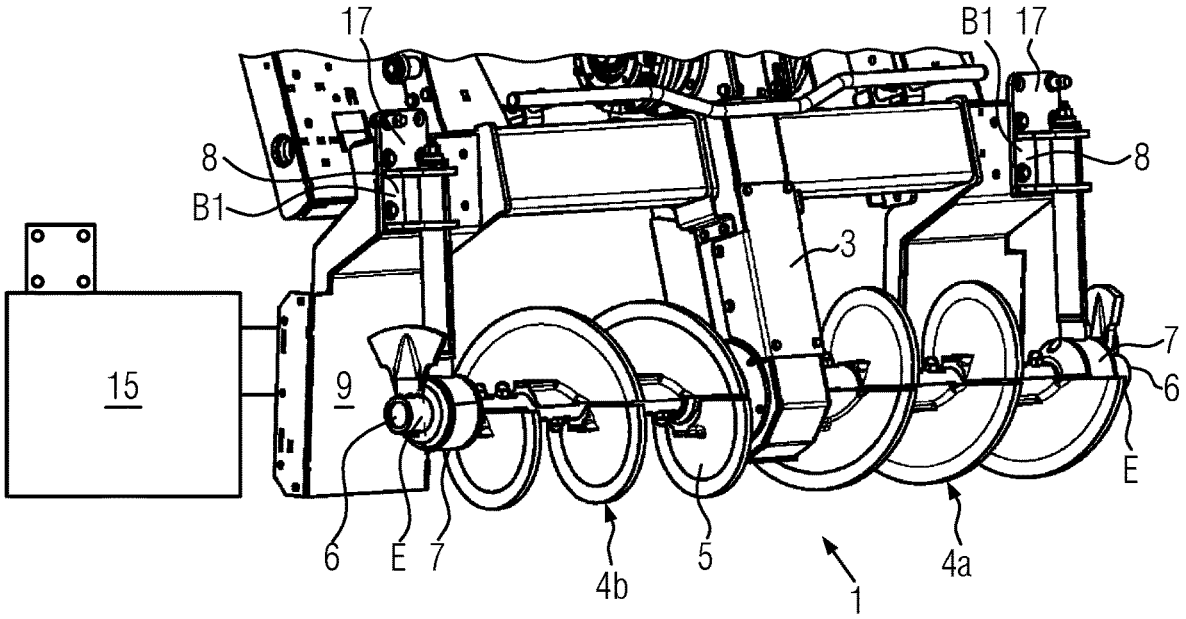
FIG. 2 shows a schematic perspective view of a transverse distributor arrangement.

FIG. 1 shows a road finisher 2 and FIG. 2 shows a transverse distributor arrangement 1 of a road finisher 2. The transverse distributor arrangement 1 comprises an auger 4*a* arranged on the right-hand side in the direction of travel of the road finisher and an auger 4*b* arranged on the left-hand side. Both augers 4*a*, 4*b* are mounted centrally on a center console 3 and extend from the center console 3 to the outer end areas E. The center console 3 is attached to a body of the road finisher 2 (e.g., frame or structural element of the road finisher 2). In the housing formed by the center console 3 there is an auger-drive (not shown) for driving the two augers 4*a*, 4*b*.

Each auger 4*a*, 4*b* has a base shaft 6, which can be two individual shafts 6 or a common shaft 6, and one or more auger elements 5 are mounted on the base shaft 6. The outer end E of each base shaft 6 facing away from the center console 3 is supported by an outer bearing 7. Each outer bearing. 7 is mounted at the lower end of an outer bearing bracket 8, which is attached to a first attachment point 131, for example, by means of an attachment plate 17. This attachment point 131 can be located on a structural element 9 of the road finisher 2, which is stationary relative to the center console 3, or on a limiting plate 15. Which is attached to the structural element 9.

In order to reconfigure the transverse distributor arrangement 1 for different working widths, either the right-hand auger 4*a*, the left-hand auger 4*b* or both augers 4*a*, 4*b* can be extended. For this purpose, the outer bearing bracket 8 is detached from the first attachment point 131 on the structural element 9 or limiting plate 15 and the outer bearing 7 is detached from the base shaft 6.

Figure 3:
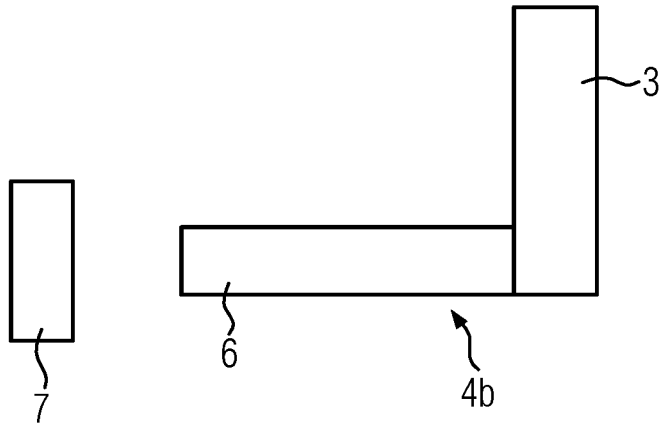
FIG. 3 shows a schematic front view of the transverse distributor arrangement from FIG. 2.

FIG. 3 schematically shows the outer bearing 7 in its state of being detached from the base shaft 6.

To reconfigure the transverse distributor arrangement 1 for different working widths, an extending shaft 10 is attached to the base shaft. In addition, the outer bearing 7 in its detached state from the base shaft 6 is detachably mounted on the extending shaft 10 and the outer bearing bracket 8 is attached to a second attachment point B2 (see FIG. 4), which may be located on the structural element 9 or the limiting plate 15. Furthermore, one or more auger elements (not shown) may be mounted on the extending shaft 10.

Figure 4:
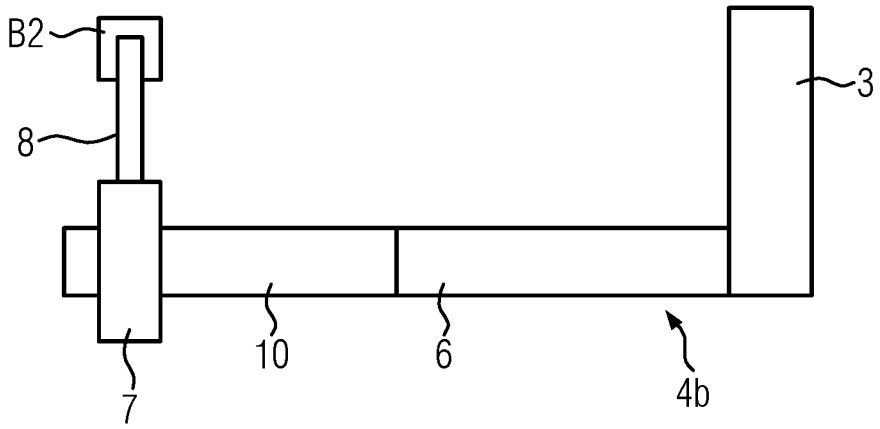
FIG. 4 shows a schematic front view of the transverse distributor arrangement from FIG. 2 in an extended state.

FIG. 4 shows the outer bearing 7 in its detached state from the base shaft 6 and mounted detachably on the extending shaft 10. The outer bearing bracket 8 is now mounted at the second attachment point B2.

To reconfigure the transverse distributor arrangement 1 for different working widths, the outer bearing 7 is alternatively mounted in its detached state on a replacement base shaft 11, which is longer or shorter than the base shaft 6, in a detachable manner. In addition, one or more auger elements (not shown) may be mounted on the replacement shaft 11.

Figure 5:
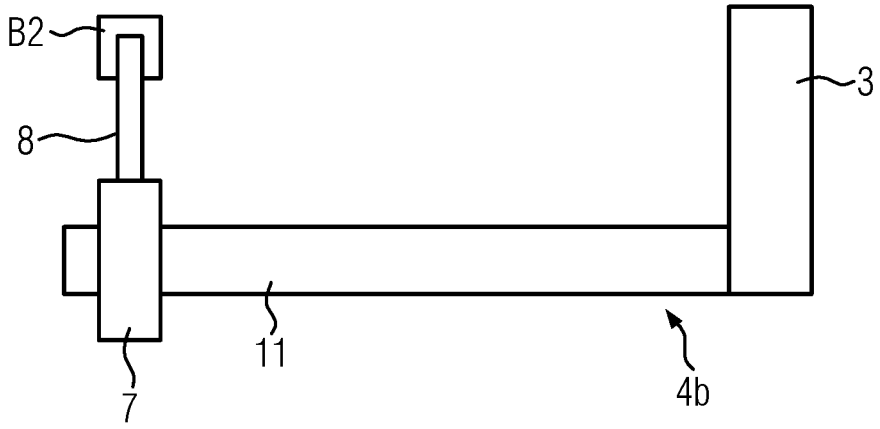
FIG. 5 shows a schematic front view of the transverse distributor arrangement from FIG. 2 in another extended state.

FIG. 5 shows the outer bearing 7 in its detached state from the base shaft 6 and then already detachably mounted on the replacement base shaft 11.

Figure 6:
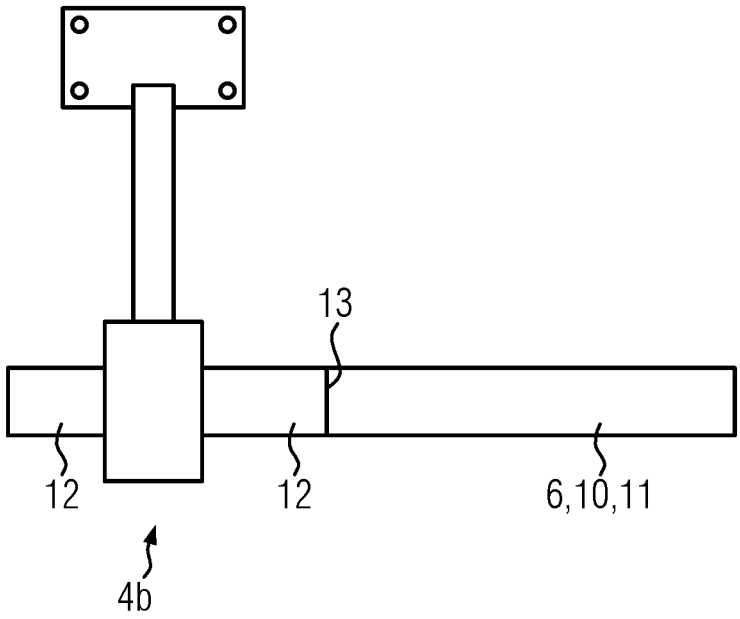
FIG. 6 shows a schematic front view of an embodiment of the disclosure in which an outer bearing with transition wings is attached.

FIG. 6 shows an embodiment of the disclosure in which an outer bearing 7 is rotatably mounted with transition wings 12. In this embodiment, the transition wing 12 of the outer bearing 7 is mounted detachably and non-rotatably with a base shaft 6, an extending shaft 10 or a replacement base shaft 11. The detachable and non-rotatable connection between the transition wing and the shaft is created by means of connecting elements 13, disclosure screws or springs.

Figure 7:
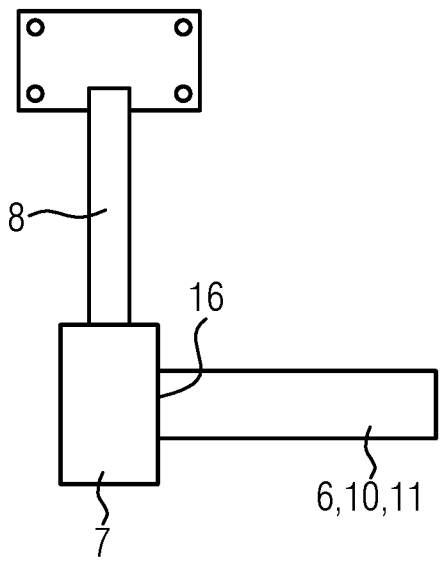
FIG. 7 shows a schematic front view of an alternative embodiment of the disclosure, in which an outer bearing is detachably connected to the shafts without tools and axially secured to them.

FIG. 7 shows an alternative embodiment of the disclosure with an outer bearing 7 and shafts 6, 10, 11 mounted on it in a connection that can be detached without tools.

Figure 8:
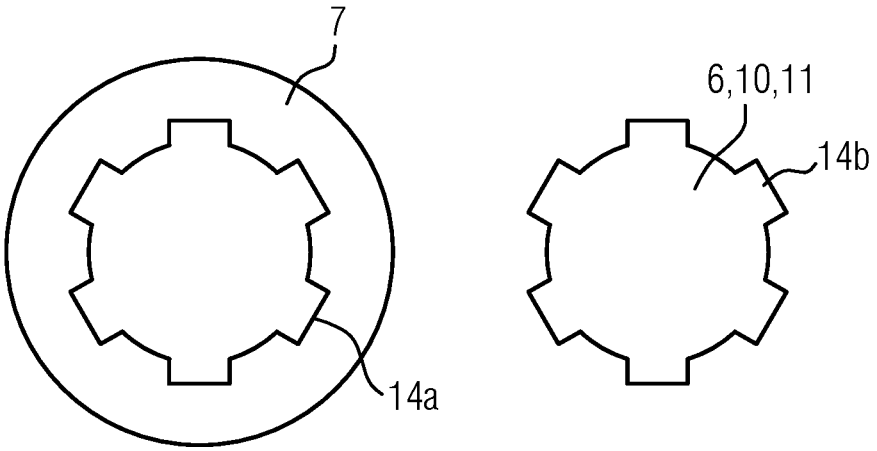
FIG. 8 shows a schematic side view of the outer bearing and shafts from FIG. 7 with their spline profiles.

FIG. 8 shows the spline profiles 14*a*, 14*b* of the outer bearing 7 and shafts 6, 10, 11 in front view. In order to create a connection between the outer bearing 7 and the shafts 6,

10, 11 that can be detached without tools and is rotationally fixed, the outer bearing 7 has, for example, a spline profile 14*a* that is designed to complement a second spline profile 14*b* of the base shaft 6, the broadened shaft 10 or the replacement base shaft 11 at their respective end areas E The spline profiles 14*a*, 14*b* can have different tooth shapes, disclosure polygon or classic hexagon.

In order to secure the connection between the outer bearing 7 and the shafts 6, 10, 1.1, which can be detached without tools, axial securing 16, disclosure a retaining ring, can be arranged.

What is claimed is:

1. A transverse distributor arrangement for a road finisher, comprising a center console and augers extending in opposite directions, the augers each having auger elements mounted thereon and a base shaft extending from the center console to an outer end region, wherein the base shaft is mounted in an outer bearing that is mountable at an attachment point via an outer bearing bracket, wherein an extending shaft can be fitted to the base shaft or the base shaft can be replaced by a replacement base shaft of a different length than the base shaft, wherein the base shaft and the outer bearing are detachably connected to each other, and wherein the outer bearing in a state detached from the base shaft is detachably mountable on the extending shaft or on the replacement base shaft.

2. The transverse distributor arrangement according to claim 1, wherein the attachment point is arranged on a structural element of the road finisher which is stationary relative to the center console or on a limiting plate which is attached to the structural element.

3. The transverse distributor arrangement according to claim 1, wherein the outer bearing comprises one or more transition wings.

4. The transverse distributor arrangement according to claim 3, wherein a transition wing of the outer bearing is mountable with the base shaft or the extending shaft or the replacement base shaft via one or more connecting elements.

5. The transverse distributor arrangement according to claim 1, wherein the outer bearing can be mounted with the base shaft or with the extending shaft or with the replacement base shaft in a connection which can be released without tools.

6. The transverse distributor arrangement according to claim 1, wherein the outer bearing has a spline profile, the base shaft and the extending shaft or the replacement base shaft having another spline profile complementary to the spline profile of the outer bearing.

7. The transverse distributor arrangement according to claim 1, wherein the base shaft or the extending shaft or the replacement base shaft is axially securable with the outer bearing.

8. A method of assembling a transverse distributor arrangement for a road finisher, the method comprising:

detaching an outer bearing bracket from a first attachment point;

detaching an outer bearing from a base shaft;

mounting an extending shaft to the base shaft;

mounting the outer bearing bracket at a second attachment point; and detachably attaching the outer bearing to the extending shaft.

9. The method according to claim 8, further comprising:

detaching an axial securing device between the base shaft and the outer bearing, and axially securing the extending shaft on the outer bearing.

10. The method according to claim 8, wherein the first attachment point is arranged on a structural element of the road finisher that is stationary relative to the center console or on a limiting plate that is attached to the structural element.

11. The method according to claim 10, wherein the second attachment point is arranged on the structural element of the road finisher or on the limiting plate.

12. The method according to claim 8, wherein the second attachment point is arranged on a structural element of the road finisher that is stationary relative to the center console or on a limiting plate that is mounted on the structural element.

13. A method of assembling a transverse distributor arrangement for a road finisher, the method comprising:

detaching an outer bearing bracket from a first attachment point;

detaching an outer bearing from a base shaft;

replacing the base shaft by a replacement base shaft which has a different length than the base shaft;

mounting the outer bearing bracket at a second attachment point; and detachably attaching the outer bearing to the replacement base shaft.

14. The method according to claim 13, further comprising:

detaching an axial securing device between the base shaft and the outer bearing; and axially securing the replacement base shaft on the outer bearing.

15. The method according to claim 13, wherein the first attachment point is arranged on a structural element of the road finisher that is stationary relative to the center console or on a limiting plate that is attached on the structural element.

16. The method according to claim 15, wherein the second attachment point is arranged on the structural element of the road finisher or on the limiting plate.

17. The method according to claim 13, wherein the second attachment point is arranged on a structural element of the road finisher that is stationary relative to the center console or on a limiting plate that is mounted on the structural element.

* * * * *